US006328087B1

(12) United States Patent
Finzo et al.

(10) Patent No.: US 6,328,087 B1
(45) Date of Patent: Dec. 11, 2001

(54) STRAPPING APPARATUS

(75) Inventors: Flavio Finzo, Würenlos; Giancarlo Haltinner, Schänis; Bernd Marsche, Uster; Ludovigo De Felice, Niederweningen, all of (CH)

(73) Assignee: Orgapack GmbH, Dietikon (CH)

( * ) Notice: Subject to any disclaimer, the term of this patent is extended or adjusted under 35 U.S.C. 154(b) by 0 days.

(21) Appl. No.: 09/429,368

(22) Filed: Oct. 28, 1999

(30) Foreign Application Priority Data

Oct. 29, 1998 (CH) ..... 2188/98

(51) Int. Cl.[7] ..... B29C 65/06

(52) U.S. Cl. ..... 156/494; 156/73.5; 156/580; 100/32

(58) Field of Search ..... 156/73.5, 229, 156/494, 495, 502, 580; 100/29, 32, 33 PB

(56) References Cited

U.S. PATENT DOCUMENTS

| | | | | |
|---|---|---|---|---|
| 3,783,079 | * | 1/1974 | Wehr | 156/502 |
| 3,799,835 | * | 3/1974 | Gilmore | 156/580 |
| 4,015,643 | | 4/1977 | Cheung | 140/93.4 |
| 4,483,516 | * | 11/1984 | Wehr | 254/199 |

FOREIGN PATENT DOCUMENTS

| | | |
|---|---|---|
| 2 102 344 | 9/1972 | (DE) . |
| 0 744 343 | 11/1996 | (EP) . |
| 2 193 693 | 2/1974 | (FR) . |
| 881038 | 11/1961 | (GB) . |
| 2 098 164 | 11/1982 | (GB) . |

OTHER PUBLICATIONS

German Search Report.

* cited by examiner

*Primary Examiner*—James Sells
(74) *Attorney, Agent, or Firm*—Lowe Hauptman Gilman & Berner, LLP

(57) ABSTRACT

In a strapping apparatus for strapping goods with a band, which apparatus has a tensioning device which is operatively connected to a tensioning drive and is intended for tensioning the band, a closure device for sealing two ends of a band, and a plurality of rewinding locks for fixing the band on the strapping apparatus, highest possible efficiency is to be achieved. The invention proposes providing the tensioning device with a rocker (37) arranged opposite a tensioning wheel (30), mounting the rocker (37) pivotably about a rocker axis (38) and designing the tensioning wheel (30) and the rocker (37) in such a way that they can be moved towards each other, as a result of which the band can be clamped between the rocker and the tensioning wheel, and the band rests on the tensioning wheel with a large angle of wrap (α).

22 Claims, 7 Drawing Sheets

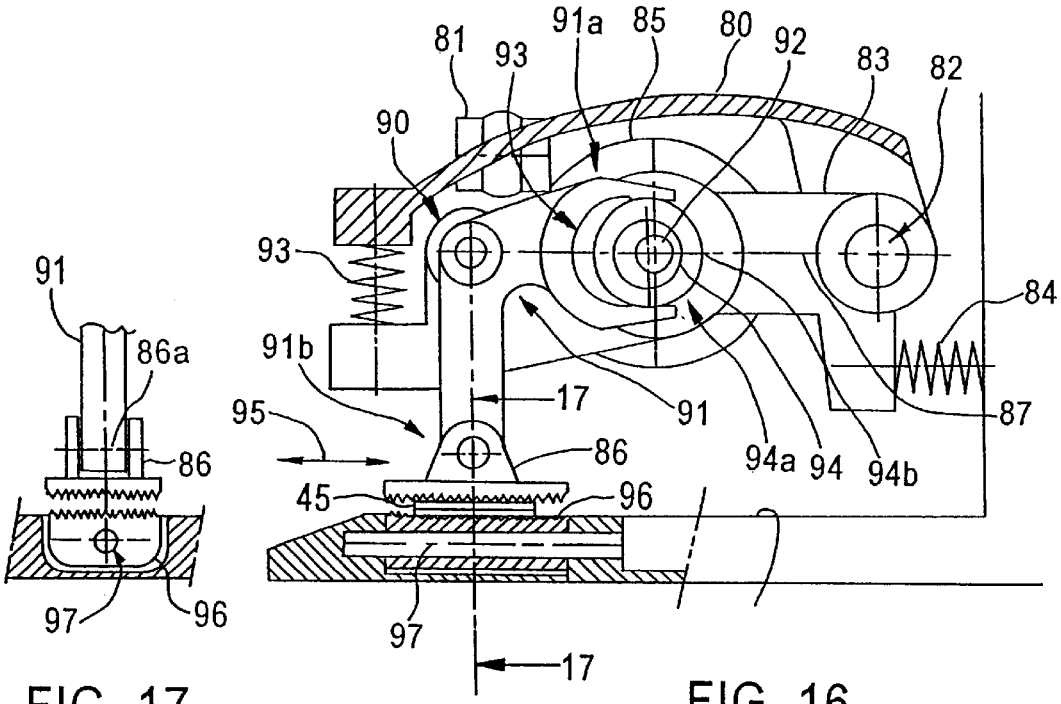
FIG. 17
FIG. 16
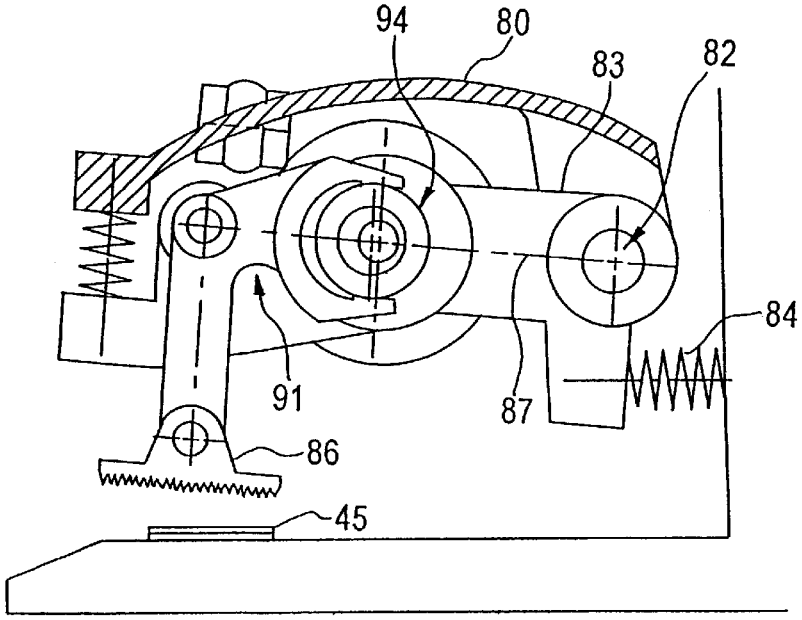
FIG. 18

STRAPPING APPARATUS

The invention concerns a strapping apparatus for strapping goods with a band, the strapping apparatus having a tensioning device which is operatively connected to a tensioning drive and is intended for tensioning the band, a closure device for sealing two ends of a band, and a plurality of rewinding locks for fixing the band in the strapping apparatus.

The invention relates primarily to portable, mobile, i.e. not stationary and permanently installed, strapping apparatuses which are preferably electrically driven and are provided with a mains-independent power supply, such as a storage battery for example. In the case of such apparatuses, there is always the problem that—with a predetermined number of strappings that can be carried out with one storage battery charge—the tensioning force that can be applied as a maximum to each strapping is limited by the relatively low storage battery capacity available. The tensioning force ultimately remaining in a band loop is also reduced by the fact that, during the formation and closing of the band loop, the band is usually guided over a base plate, with which the strapping apparatus rests against the goods. Once the band loop has been closed, the strapping apparatus is removed from the goods and the base plate is thereby pulled out of the band loop. Since, as a result, the circumference to be strapped by the already closed band loop is reduced, the tensioning force in the band also subsides.

The invention is therefore based on the object of providing a strapping apparatus with an improved efficiency, in particular with respect to the utilization of a storage battery charge. In this connection, "efficiency" can be understood to mean the number of strappings with a specific band tension that can be achieved with a specific storage battery capacity. However, it can also be understood to mean the magnitude of the maximum band tension that can be achieved per strapping when carrying out a specific number of strappings—utilizing the full storage battery partial capacity.

This object is achieved according to a first aspect of the invention in that, in the case of a strapping apparatus mentioned at the beginning, in particular a portable strapping apparatus that is independent of an external energy source, a tensioning wheel which can be driven preferably without a flexible drive (such as a V-belt for example) by a motor—preferably with a gear mechanism interposed—is supported against a rocker during a tensioning phase. In order that the band can be inserted as easily as possible between the rocker and the tensioning wheel, a distance between the tensioning wheel and the rocker should be variable. In order to achieve this, the tensioning wheel is preferably mounted pivotably.

It has proved to be favourable if the rocker can be aligned automatically according to the magnitude and direction of the pressure exerted by the tensioning wheel. This leads to particularly good pressing conditions between the tensioning wheel and the band and consequently to good efficiency with regard to the amount of energy required for a strapping with a specific band tension. Consequently, more strappings than were previously customary can be carried out with the same total available capacity of a storage battery.

It contributes in particular to high efficiency if two arms of the rocker are provided in each case with a rotatable roller, over which the band to be tensioned is guided. The rollers, expediently provided with the same diameters, are preferably much smaller than the tensioning wheel. During tensioning of the band, the section of the band respectively situated between the rollers should rest against the tensioning wheel and the two rollers. A relatively large angle of wrap of the band around the tensioning wheel can be achieved with the two rollers, with at the same time low friction between the rocker and the band, whereby the risk of band deformations and slippage between the band and the tensioning wheel can be reduced. Both band deformations and slippage can increase the drive power required.

In this case it may also be advantageous if the rocker is provided—preferably instead of the rollers—with a pressure-exerting surface, onto which the band is pressed by the tensioning wheel during the tensioning phase. The pressure-exerting surface may have a curvature which is expediently adapted to the radius of the tensioning wheel, whereby the band hugs the tensioning wheel particularly well.

To achieve least possible loss of already applied band tension, it may be provided that a first part of the base plate is assigned to the closure device and a second part of the base plate is assigned to the tensioning device, and between the two parts there is formed a passage through which a section of a band loop can be passed.

In the case of strapping apparatuses, it is usually provided that the tensioning device, the closure and cutting device and the rewinding locks, such as clamping devices for example, are supported on the base plate. Therefore, the band is guided over a comparatively long base plate—seen in the direction of the band. Since, after the closing of the band loop, the base plate is pulled out from the latter, the band tension then also subsides to a relatively great extent. The invention may deviate from this by reducing the length of the path of the band loop on the base plate. This can be achieved by the band loop being guided only over that part of the base plate on which the devices that act on the band loop are arranged. In the case of devices according to the invention, it may therefore preferably be provided that the tensioning device is arranged after the closure device—seen in the tensioning direction—and acts on a section of the band that is not part of the band loop. Since the tensioning device is expediently likewise supported on the base plate, the band loop can be passed through a clearance in the base plate. The clearance may be situated between the closure device and a tensioning wheel of the tensioning device. In order to form such a clearance between two parts of the base plate, the two parts of the base plate may be integrally connected to each other or else be separate components which are joined together in a suitable way to form a base plate. The path of the band loop over the base plate can be shortened by this measure, whereby the loss of band tension caused by removing the strapping apparatus from the goods can be reduced.

The efficiency of a strapping apparatus is also influenced by the current required by the welding device for welding two layers of the band. According to a further aspect of the invention, therefore, a welding device with which the energy made available by an energy source for the welding operation is used particularly efficiently is to be provided for a strapping apparatus. In order to achieve an improvement here, it may be provided in the case of a strapping apparatus mentioned at the beginning that the welding device has a lever, on the one end of which an eccentric which is operatively connected to a motor shaft acts for the purpose of transmitting an eccentric movement, with regard to the motor shaft, to the lever, the other end of which is operatively connected to a welding shoe, the lever being mounted pivotably between its two ends on a pivot spindle, so that the movement of the eccentric results in an oscillating and essentially straight reciprocating movement of the welding shoe. In order that the welding shoe executes an essentially straight movement in spite of the pivoting movement of the lever, there should act (directly or indirectly) on the lever a force, preferably a spring force, which presses the lever during the entire welding operation or sequence of movements in the direction of the base plate and consequently onto the band to be welded.

In a preferred embodiment of the invention, the motor is arranged on a support, with respect to which the lever can execute only rotary pivoting movements. A solution of a particularly simple structural design is obtained if the lever is mounted directly on the support.

It is preferred here if the eccentric is arranged in a slot-like clearance in the lever, for example a fork, and rests against the said lever at two essentially diametrically opposite points.

In the case of such embodiments of the invention put into practice, it has been found that they permit a particularly quiet welding operation.

A further expedient embodiment of the invention may provide that the support is mounted pivotably about a rotational spindle and the force for pressing the melding shoe onto the band is introduced via the support onto the lever into the welding shoe.

It may also contribute to improving the efficiency if the welding shoe presses the two band layers to be welded onto an abutment support. The abutment support should be serrated and can preferably be arranged on the base plate.

In a further embodiment, a strapping apparatus has at least two rewinding locks, with which the band can be fixed. In this case, the closure device should be arranged between the two rewinding locks. This arrangement has proved successful in particular for applications in which the band is "pulled out" from the closure device by the tensioning device, and not "pushed in", during the tensioning operation. That is to say, it is a structural design of a strapping apparatus in which the tensioning device is arranged behind the closure device in the tensioning direction.

It is particularly preferred, however, if a third rewinding lock is present, with which the tensioning wheel can be fixed. In this case, the tensioning wheel should be arrestable, at least against rotational movements in the tensioning direction. With this arrangement it is possible for the band which has been pulled through the closure device during the tensioning operation to be fixed with the already applied band tension for the closing and cutting operation. Nevertheless it is possible for that section of the band which is subsequently friction-welded and cut to be essentially relieved again of the band tension. This has the advantage that the movement of the welding shoe preferably taking place essentially transversely with respect to the longitudinal extent of the band can be converted better into heat of the band, and that clean cutting edges are produced during cutting of the plastic band. Plastic bands under tension tend to split during cutting.

The invention also concerns a strapping apparatus, mentioned at the beginning, in which control functions for rewinding locks are transmitted from a hand lever to the rewinding locks via a control board. The control board preferably transmits the control functions for all the rewinding locks present. This allows the number of individual parts to be reduced, whereby the weight of the strapping apparatus, intended as a mobile hand-operated apparatus, can be reduced. Since all the control functions are initiated from a central hand lever, operating the strapping apparatus is also made easier as a result.

A structurally particularly simple and space-saving design of a strapping apparatus according to the invention may provide that the control board is connected to the hand lever via a pivot lever. Transmitting means, for example rotational spindles, by which the rewinding locks are transferred from a locking position into an inserting position or vice versa, may be connected to the control board.

Further preferred refinements of the invention emerge from the dependent claims.

The invention is explained in more detail on the basis of the exemplary embodiments represented schematically in the figures, in which:

FIG. 16 shows part of a possible welding device according to the invention—located in a welding position—in a partially sectioned representation. The welding device from FIG. 16 differs from the welding device represented in a highly schematized form in FIG. 1;

FIG. 17 shows a sectional representation according to the line D—D from FIG. 16;

FIG. 18 shows the welding device from FIG. 16 in an inserting position.

Figure 1:
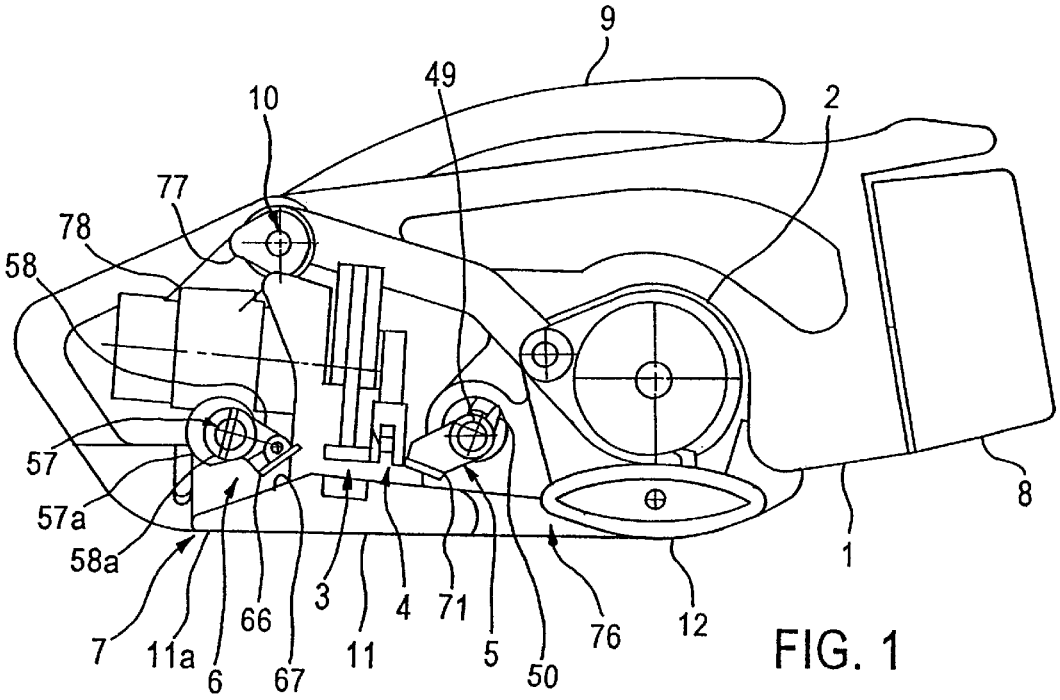
FIG. 1 shows a strapping apparatus according to the invention in a first side view, a hand lever being located in a first end position.

Shown in FIG. 1 is a strapping apparatus according to the invention, in the housing 1 of which there are arranged a tensioning device with a tensioning drive 2, a closure device 3, designed as a welding device, a cutting-off device 4, as well as three rewinding locks, of which only the two rewinding locks 5, 6 can be seen however in FIG. 1. The housing 1 has beneath these components a base plate 7, which is subdivided into two arms 11, 12. The two arms 11, 12 are arranged at a distance from each other and provide an opening between them. A supporting surface lla of the arm 11 for arranging the strapping apparatus on goods may, in other exemplary embodiments of the invention not represented, be concavely curved, in order that the apparatus can also be securely arranged on round goods.

All the functions of the strapping apparatus provided with a battery or a storage battery 8 are initiated by a hand lever 9, which can be pivoted about a rotational spindle 10, mounted on the housing 1, from a first end position into a second end position. As can be seen in particular in FIG. 3, a first pivot arm 13 is arranged in a rotationally fixed position on the rotational spindle 10. The pivot arm 13 is also fastened on a plate-shaped and essentially triangular control board 14, which also has a second pivot arm 15 and a butt strap 16 coupled to it. The butt strap 16 is provided with a slotted link 17.

Figure 4:
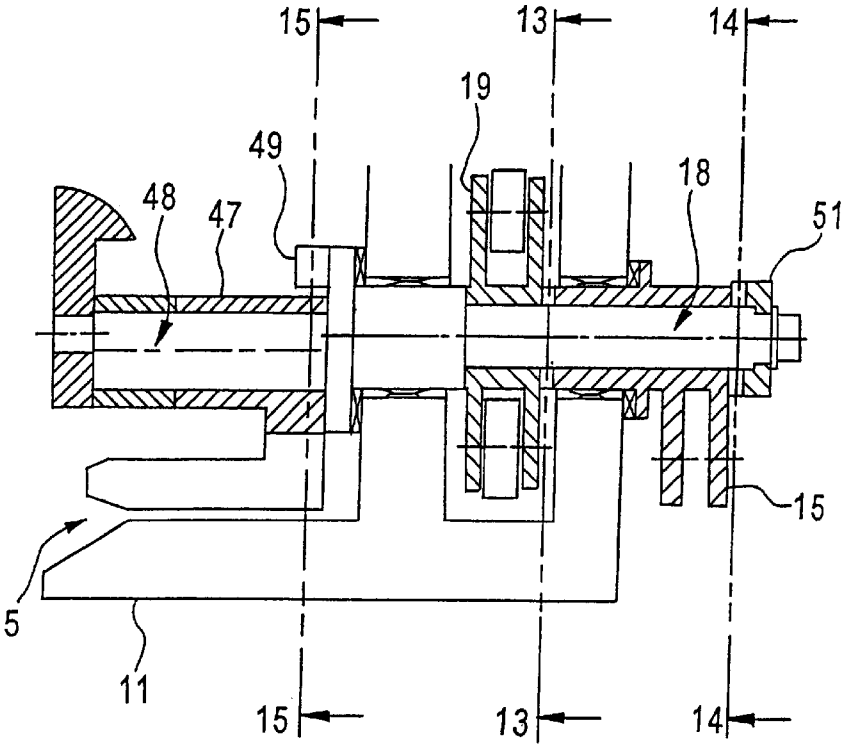
FIG. 4 shows a sectional representation of a rotational spindle of the strapping apparatus.
Figure 5:
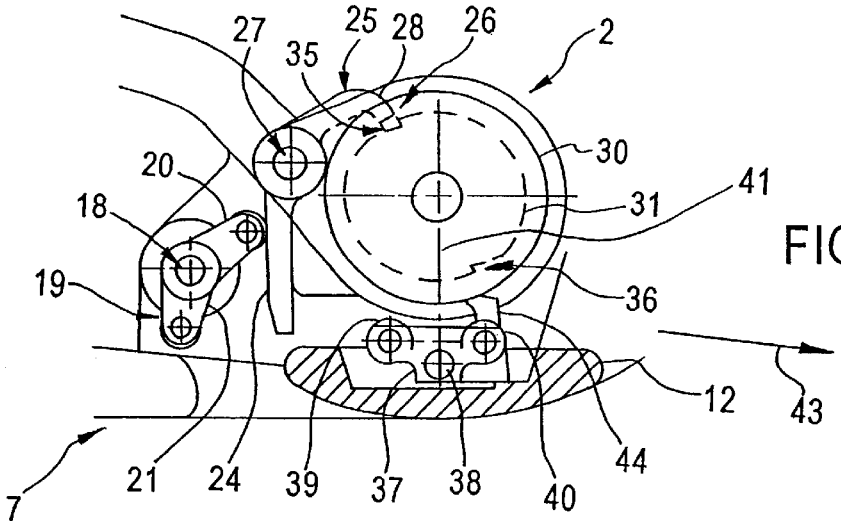
FIG. 5 shows a tensioning drive of the strapping apparatus.

In FIGS. 4 and 5 it is shown that on a rotational spindle 18 of the second pivot arm 15 there is a first double lever 19, which has two lever arms 20, 21. Respectively arranged at the ends of the two lever arms 20, 21 there is at least one freely rotatable roller. In the pivoting range of the first double lever there is a lever arm 24 of a second double lever 25, which belongs to a third rewinding lock 26. The second double lever 25 is arranged on a pivot spindle 27 of the tensioning drive and has a second lever arm, which is provided with a catch 28.

The tensioning drive 2, likewise mounted on the pivot spindle 27, can be pivoted about the pivot spindle 27 by actuation of the hand lever. The tensioning drive 2 has a tensioning wheel 30, arranged on a shaft of a d.c. motor, which is not represented in any more detail. Arranged coaxially with respect to the tensioning wheel 30 on the same shaft is a ring gear 31 of a planetary gear mechanism, the circumference of which is provided with two diametrically opposite depressions 35, 36. The depressions 35, 36 are intended for the engagement of the catch 28 of the third rewinding lock 26. By such an engagement, the ring gear 31 can be locked against anticlockwise rotational movements. It should be taken into consideration here that all the references to a direction of rotation of course always relate to the respective representation in the figures.

It is not represented in the figures that not only is the planetary gear mechanism intended for achieving a step-down transmission arranged coaxially with respect to the tensioning wheel 30, but also the d.c. motor is arranged coaxially with respect to the two aforementioned components. This arrangement also contributes to achieving a high efficiency with the strapping apparatus. In order to increase the efficiency, the planetary gear mechanism has three step-down stages—instead of the two stages otherwise customary in the case of hand-operated strapping apparatuses.

Figure 6:
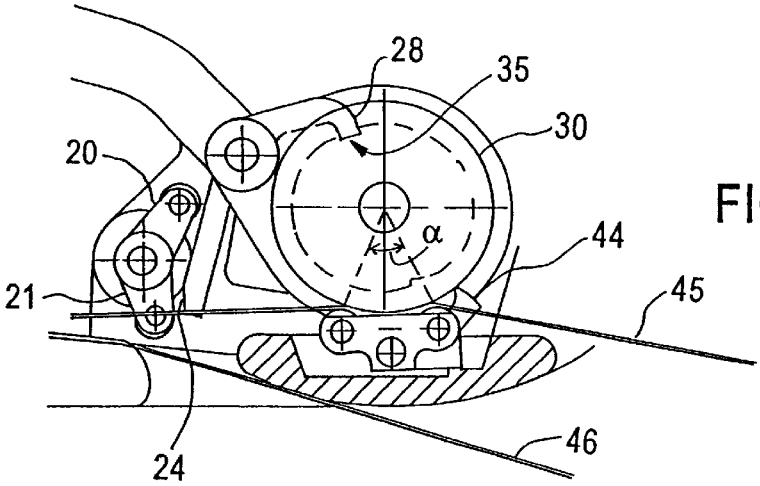
FIG. 6 shows the tensioning drive from FIG. 5 during a tensioning phase.
Figure 7:
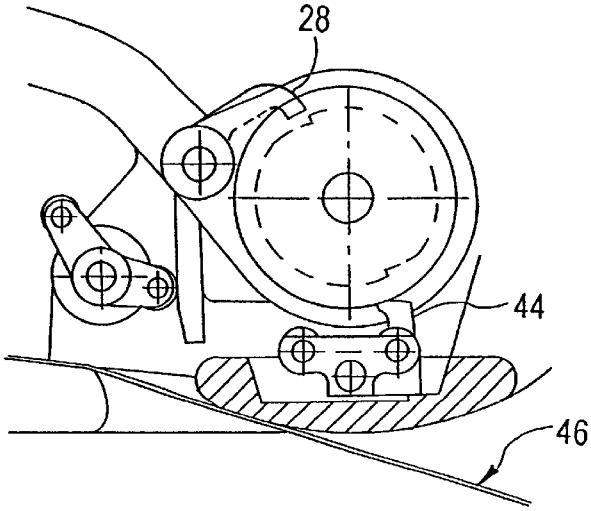
FIG. 7 shows the tensioning drive from FIG. 5 during a welding operation.

The second arm 12 of the base plate 7 (FIG. 1) is arranged beneath the tensioning wheel 30. In a depression in the second arm 12 there is a rocker 37, which can be pivoted about a rocker axis 38 (FIGS. 5–7). The mounting of the rocker 37 is performed in this case in such a way that it can turn freely about its rocker axis 38, whereby it aligns itself according to the magnitude and effective direction of the applied pressure of the band or of the tensioning wheel 30. Attached at the ends of two rocker arms of essentially the same length there is in each case a freely rotatable abutment roller 39, 40, which acts without a belt of a flexible drive, such as a V-belt for example, directly on the strapping band. Of the two axes of the abutment rollers 39, 40, aligned essentially parallel to the rocker axis, one axis or abutment roller is situated—with regard to the tensioning direction (arrow 43)—in front of the rocker axis 38 and the other abutment roller is situated behind it. The distances of the axes of the abutment rollers 39, 40 from the rocker axis 38 are consequently essentially equal. Furthermore, it can be seen in the representations of FIGS. 5–7 that an imaginary joining line 41 from a rotational spindle of the tensioning wheel to the rocker axis 38 is aligned essentially orthogonally with respect to the arm 12 of the base plate.

The tensioning wheel 30 can be brought into contact with the two rollers 39, 40 by a pivoting movement about the pivot spindle 27. The distance between the two abutment rollers should therefore be dimensioned in such a way that an adequate angle of wrap ($\alpha$) of the band on the tensioning wheel is obtained (FIG. 6). This is to be understood as meaning that the angle of wrap should be of such a size that slippage of the band with respect to the tensioning wheel can be at least essentially avoided. In the exemplary embodiment represented, the distance between the two abutment rollers 39, 40—which are much smaller than the tensioning wheel—is approximately 70% of the radius of the tensioning wheel. It goes without saying that this value can vary in dependence on, for example, the force of the pressure applied by the tensioning wheel to the rocker, the nature of the surface and the material of the tensioning wheel, the type of band, etc. Finally, on account of the geometrical conditions, it may also be provided that a resultant force of the pressure applied by the tensioning wheel to the rocker 37 does not intersect the rocker axis. As a result, when pressure is applied by the tensioning wheel to the rocker there is always a torque about the rocker axis 38, whereby particularly good alignment of the rocker with respect to the tensioning wheel can be achieved.

Mounted on the same shaft of the rocker 37 as the abutment roller 40 of the rocker 37 at the rear in the tensioning direction (arrow 43) there is also a pivotable catch 44. In a basic position shown in FIG. 5, the catch 44 is aligned essentially vertically. In this basic position, the tensioning wheel 30 is supported only on the catch 44. As a result, between the tensioning wheel 30 and the abutment rollers 39, 40 there forms a gap, into which the band 45 to be tensioned—shown in FIG. 6—can be inserted. As can be seen from FIG. 6, the tensioning wheel 30 takes the catch 44 with it during anticlockwise rotational movements. As result, the said catch turns clockwise into another end position, in which the tensioning wheel 30 can be lowered onto the rocker 37. This is the tensioning position of the strapping apparatus, in which a tensioning force is applied to a band loop 46. Since the rocker 37 is pivotably mounted, it is thereby adjusted in such a way that the two abutment rollers 39, 40 can absorb forces occurring during tensioning and can divert them into the base plate 7.

Figure 15:
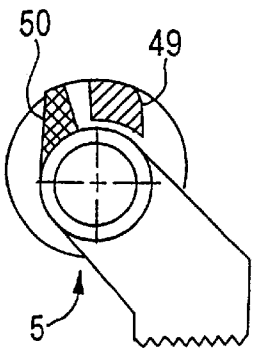
FIG. 15 shows a sectional representation along the line C—C in FIG. 4.

The front rewinding lock 5, shown in FIG. 1, is mounted—in a way corresponding to the representation of FIG. 4—with a sleeve-shaped section 47 on an eccentric spindle 48, which in turn is arranged on the rotational spindle 18. This mounting is performed in such a way that the front or first rewinding lock 5 is relatively rotatable with respect to the rotational spindle 18. The rewinding lock 5 is provided with a spring (not represented), which acts approximately in the direction of band pulling and by which the rewinding lock 5 is pressed onto the first arm 11 of the base plate 7. The transmission of a rotational movement takes place by contact of a driving cam 49, which is arranged on the eccentric spindle and presses against a driving cam 50 provided on the sleeve-shaped section (FIGS. 4 and 15). The coupling of the rewinding lock 5 to the eccentric spindle 48 consequently takes place by a positive engagement of the two driving cams 49, 50.

Figure 14:
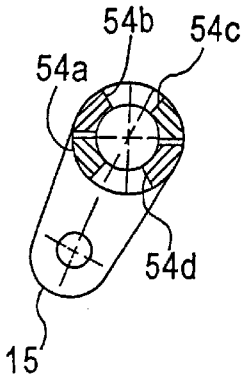
FIG. 14 shows a sectional representation along the line B—B in FIG. 4.

At one end of the rotational spindle 18 of the second pivot arm 15 there is also an indexing plate 51, which is connected in a rotationally fixed manner to the rotational spindle 18. The indexing plate 51 is subjected to force for clockwise rotational movements by a spring 42, represented in FIG. 3. The indexing plate 51 has on its end faces claws 54*a*, 54*c* of a coupling (cf. FIG. 14), by which the indexing plate 51 can be connected in a rotationally fixed manner to the pivot arm 15. For this purpose, the two claws 54*a*, 54*c* are respectively arranged in a diametrically opposite relationship on an end face of the indexing plate 51. Two other claws 54*b*, 54*d* are situated on the pivot arm 15 and likewise lie in a diametrically opposite relationship. Since a claw of the pivot arm 15 respectively engages between two claws of the indexing plate, in certain rotational positions between the indexing plate 51 and the pivot arm 15 there is obtained a rotationally fixed connection in the form of a positive engagement of the claws. As a result, the pivot arm 15 takes the indexing plate 51 with it, while in other rotational positions relative movements between the two elements are possible.

Figure 13:
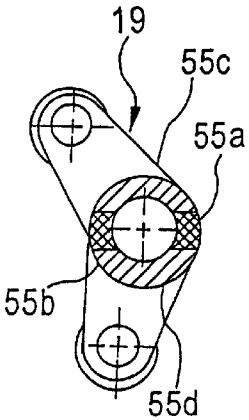
FIG. 13 shows a sectional representation along the line A—A in FIG. 4.

Unlike the second pivot arm 15, the double lever 19 is rotatably mounted on the eccentric spindle 48 and is connected in a rotationally fixed manner to the second pivot arm 15 by a further claw coupling (FIGS. 4 and 13). This coupling also has four claws 55*a*—55*d*, which engage in one another. By contrast with the claw coupling discussed above, here the claws 55*c*, 55*d* of the double lever 19 have no play in the circumferential direction with respect to the claws 55*a*, 55*b* of the pivot arm 15, thereby providing a rotationally fixed connection between the double lever 19 and the pivot arm 15 in all rotational positions. The rotational position of the double lever 19 on the eccentric spindle 48 is consequently determined by the hand lever 9 via the pivot arm 15 and the control board 14. The respective position of the hand lever 9 also has as a consequence a corresponding position of the eccentric spindle 48 with respect to the rotational spindle 18 (FIGS. 3 and 4).

Figure 8:
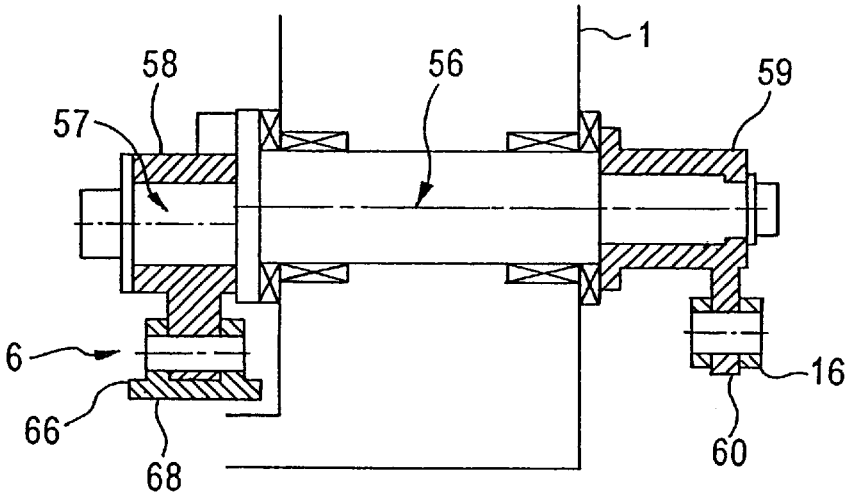
FIG. 8 shows a sectional representation of a further rotational spindle of the strapping apparatus.
Figure 9:
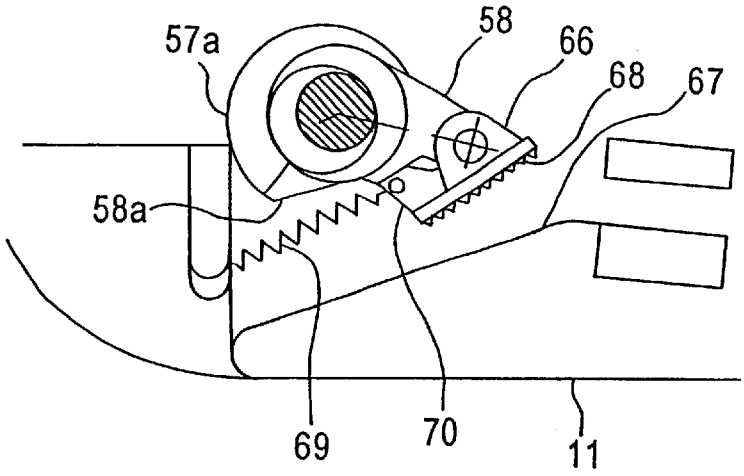
FIG. 9 shows a rewinding lock of the strapping apparatus in a first end position.
Figure 10:
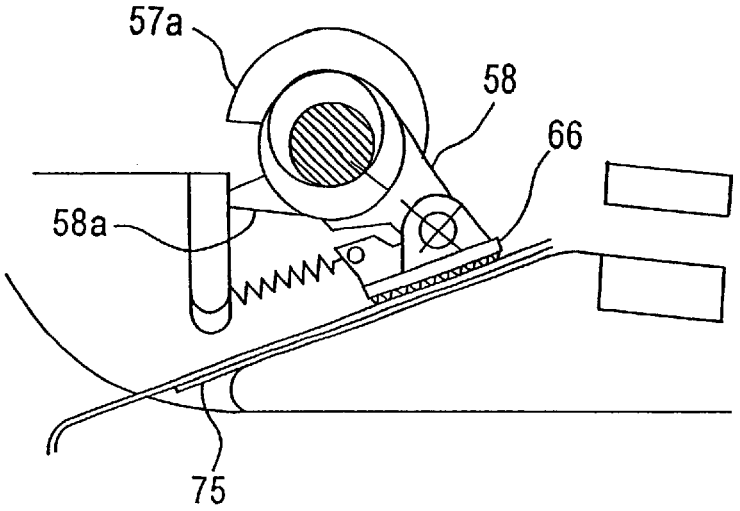
FIG. 10 shows the rewinding lock from FIG. 9 in a second end position.

The second rewinding lock 6 is actuated by a second rotational spindle 56, which is mounted on the housing 1 (FIGS. 1 and 8). For this purpose, a sleeve-shaped locking lever 58 of the second rewinding lock 6 is arranged on a second eccentric spindle 57, which is aligned eccentrically with respect to the rotational spindle 56. The eccentric spindle 57 is integrally connected to the rotational spindle 56. The locking lever 58 and the eccentric spindle 57 can be connected to each other in a rotationally fixed manner in certain rotational positions of the rotational spindle 56 by contact of a lug 58*a* of the locking lever 58 against a driver 57*a* of the eccentric spindle 57 (FIGS. 8–10). A rotationally fixed connection is shown in FIG. 9 and a constellation in which there is no rotational connection between the locking lever 58 and the eccentric spindle 57 is shown in FIG. 10.

On the rotational spindle 56 there is also a sleeve, which is designed as a catch lever 59. One of two arms 60, 61 of the catch lever 59 is guided in the slotted link 17 of the butt strap 16 pivotably coupled to the control board 14 (FIG. 3). A pivotable catch 64 may act on the other arm 61 of the catch lever 59 and, in a locking position, lock the catch lever 59 against anticlockwise rotational movements. Attached to the arm 61 of the catch lever 59 for this purpose is a tension spring 62, with which the arm 61 is pressed against a catch 64. The catch 64 in turn can be turned out of its locking position by a lug 65 of the control board 14, whereby the catch lever 59 can be moved in both directions of rotation.

Figure 3:
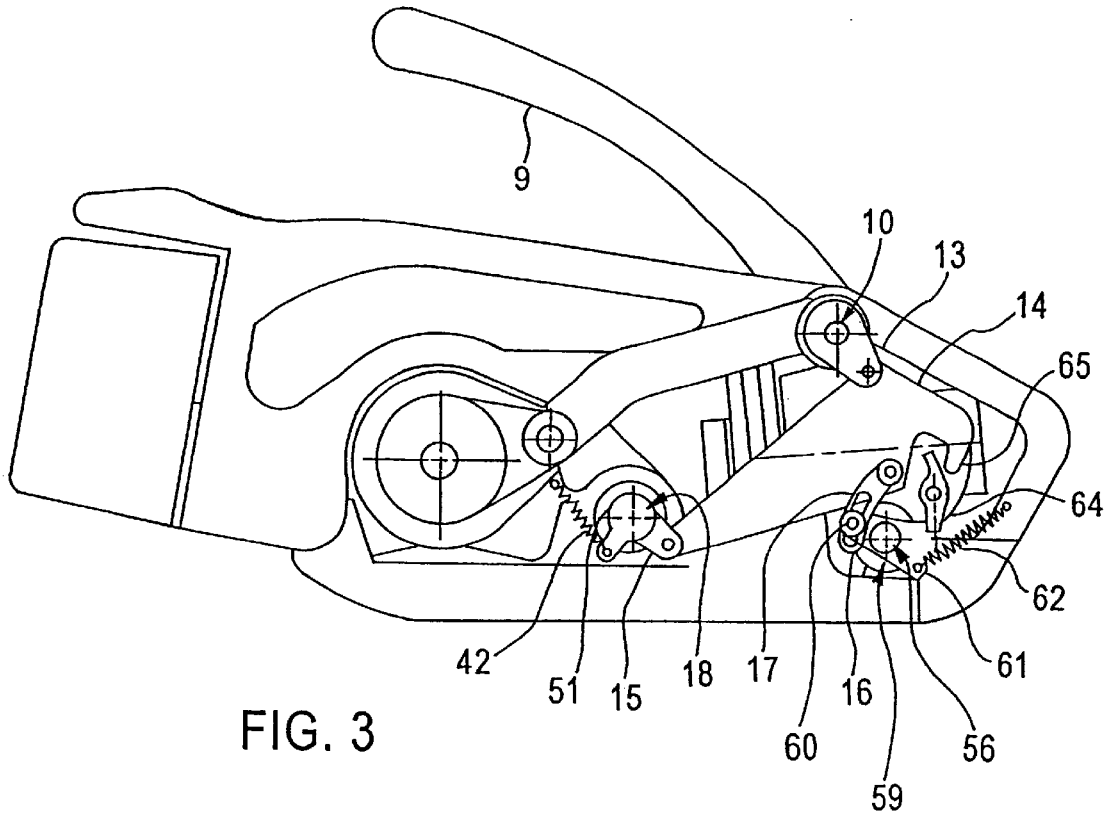
FIG. 3 shows the strapping apparatus from FIG. 2 in a view from behind.

A movement of the control board 14 initiated by the hand lever 9 leads inter alia to a rotational movement of the second rotational spindle 56, whereby the locking lever 58 executes a pivoting movement eccentric to the rotational spindle 56 (FIGS. 1, 3 and 8). By this pivoting movement, a locking plate 66, coupled in an articulated manner to the locking lever 58, can be pressed onto a slope 67 of the first arm 11 of the base plate 7 or be lifted off again from the said slope (FIGS. 9 and 10). In order that a serrated pressure-exerting surface 68 of the locking plate 66 is already aligned at least approximately parallel to the slope 67 upon first contact with the latter, the locking plate 66 is loaded by a tension spring 69. In addition, the rotational movement effected by the tension spring 69 is limited by a lug 70 of the locking plate, which comes into contact with the locking lever 58 when the locking plate 66 has been lifted off the slope.

In order that the locking plate 66 undergoes greatest possible acceleration during lowering in the direction of the base plate and, after actuation of the hand lever 9, quickly clamps the band with a high clamping force, first of all the rotary fixing of the locking lever 58 with respect to the eccentric spindle 57 must be released. This takes place by the catch 64 releasing the catch lever 59 (FIG. 3). The biased tension spring 62 arranged on the catch lever 59 then effects an abrupt rotational movement of the catch lever 59 and consequently also of the second rotational spindle 56 or the eccentric spindle 57. As a result, the driver 57*a* releases the lug 58*a*, for which reason the likewise biased tension spring 69 then turns the locking lever 58 on the eccentric spindle 57. The two rotational movements, taking place in the clockwise direction, i.e. a rotation of the eccentric spindle 57 about the rotational spindle 56 and a rotational movement of the locking lever 58 on—and consequently relative to—the eccentric spindle 57 have the effect that the locking lever undergoes a great acceleration in the direction of the base plate 7. The locking lever thereby comes from the position shown in FIG. 9 into the position represented in FIG. 10, in which the locking plate 66 presses the band against the base plate. The arrangement of the driver 57*a* of the lug 58*a* and the effective direction of the tension spring 69 (FIGS. 9 and 10) on one side and the effective direction of the tension spring 62 and the length of the slotted link 17 (FIG. 3) on the other side are matched to one another in such a way that the catch lever 59 strikes against the butt strap 16 at one end of the slotted link 17 shortly before the locking plate touches the band (FIGS. 9 and 10). As a result, the rotational movement of the rotational spindle 56 is stopped and the lug of the locking lever no longer rests against the driver 57*a* of the eccentric spindle 57. As a result, the locking lever 58 then only turns about the eccentric spindle 57 and presses into the band. The tension spring 69 thereby also has the effect that the pressure-exerting surface 68 is aligned essentially parallel to the slope 67 of the base plate and the locking plate presses its entire pressure-exerting surface onto the band right from the first contact with the band.

In FIGS. 16, 17, 18, part of a possible closure device according to the invention of the strapping apparatus is shown in a greatly schematized form. The closure device has a transmitting element in the form of a bow 80, in which an abutment cam 81—with respect to the cam 77 (FIG. 1)—is mounted, whereby the abutment cam 81 is provided with a roller. The bow 80 is, furthermore, pivotably coupled on a rotational spindle 82 to the arm 11 of the base plate of the strapping apparatus. The bow 80 consequently serves inter alia for transmitting a certain part of the pivoting movement of the lever 9 to the closure device based on the principle of friction welding.

Also mounted on the same rotational spindle 82 as the bow 80 is an approximately horizontally extending support 83, which is supported via a compression spring 84 on the arm 11 of the base plate. Arranged on the support 83 is an electric motor 85, with which an oscillating movement of a welding shoe 86 is produced. The support 83 is provided with a bearing point 90, to which an angled-away one-piece lever 91 is coupled. In this case, a drive shaft 92 of the motor 85 is situated between the rotational spindle 82 and the bearing point 90 for the lever 91, it being possible for all three components to be arranged approximately on an (imaginary) joining line 87, as is represented in FIG. 16. The support 83 is supported against the bow 80 via an elastic spring element 93, preferably a cupspring assembly.

One end 91*a* of the lever is designed as a fork, the two arms of which form a slot 93 which is open at one end. Mounted in an articulated manner at the other end 91*b* of the lever 91 is the welding shoe 86. Resting in the fork of the lever 91 is a radial anti-friction bearing, which is arranged on an eccentric element 94.

The eccentric element is in this case mounted eccentrically on the shaft 92 of the motor and is provided with an essentially circular circumferential surface, on which an inner race of the anti-friction bearing is situated. The anti-friction bearing 94*a* rests with a circumferential surface 94*b* of its outer race against both arms of the fork.

Represented in FIG. 17, finally, is a serrated abutment plate 96, against which a layer of the band is pressed during the welding operation. As can be seen in FIGS. 16 and 17, the abutment plate 96 is arranged in the arm 11 of the base plate in such a way that it can be pivoted about an axis 97 running essentially transversely with respect to the. longitudinal direction of the band in the closure device. Furthermore, the axis 97 runs orthogonally with respect to the pivot spindle 86*a* of the welding shoe 86, which in turn is aligned essentially parallel to the longitudinal direction of the band 45.

With the hand lever 9 and the cam 77 acting on the abutment cam 81 (see also FIG. 1), the closure device can be brought from the inserting position, shown in FIG. 18, into the operating position, represented in FIG. 16. During this movement, the support 83 is taken along by the bow 80 via the spring element 93. By means of a mechanism not represented in any more detail, this movement of the hand lever 9 also switches on the motor 85 of the closure device, whereby the eccentric element 94 begins to rotate. The eccentric element 94, rotating eccentrically in the fork, effects an oscillating pivoting movement of the lever 91 along an arc of a circle about the bearing point. The welding shoe thereby likewise executes an oscillating movement, which is indicated by the double-headed arrow 95. In order that the pressure required for friction welding can be applied and the welding shoe is constantly in contact with the band, the spring element 93 presses on the support 83. As a result, lifting off of the welding shoe 86 on account of the in fact arcuate pivoting movement of the lever 91 can be avoided. The compression spring 84 serves for returning the support 83 and opposes the spring element 93.

Consequently, the component of the eccentric movement that runs approximately orthogonally with respect to the joining line 87 is used for driving the welding shoe 86. The component of the eccentric movement that is approximately parallel to the joining line 87 is compensated by the slot of the fork and does not lead to any movement of the lever 91.

The pivotable arrangement of the entire closure device can bring about the effect that the band 45 can be inserted between the base plate and the welding shoe 86. Furthermore, it is also possible in this way to compensate for the different distances between the welding shoe 86 and the base plate 7 caused by different band thicknesses. This design of the closure device and, in particular, the coupling of the entire closure device to the fixed-in-position rotational spindle 82 also bring about the effect that the entire closure device executes an oscillating movement during a welding phase. "Welding phase" is to be understood here as meaning that phase in which two layers of a band 45 are welded to each other. It has being shown that, with the welding device according to the invention, particularly quiet friction welding of plastic bands is possible.

Figure 2:
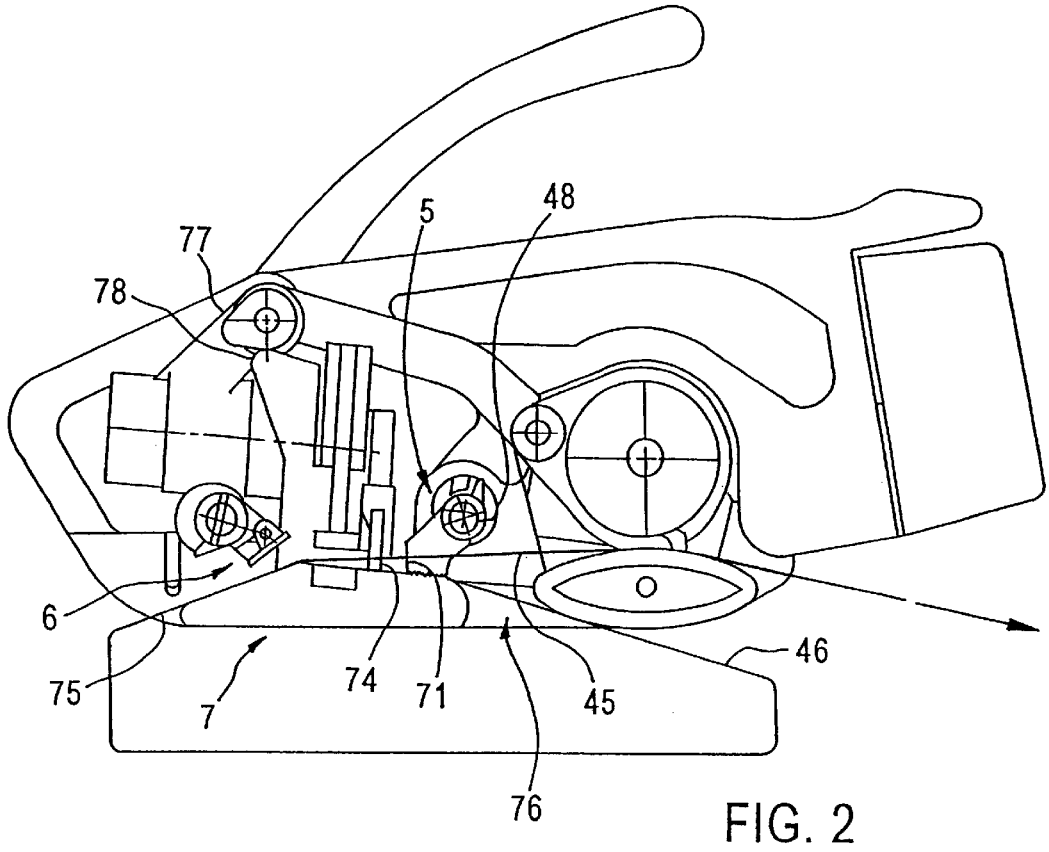
FIG. 2 shows the strapping apparatus from FIG. 1 with a different position of a hand lever.

In order to use the strapping apparatus according to the invention for placing a band loop 46 around goods, sealing it and detaching it from the supply of band, the apparatus should firstly be arranged with its base plate 7 on the goods. Furthermore, the hand lever 9 should be located in a starting position, which corresponds to the intermediate position between the two end positions that is shown in FIG. 2. In this position of the hand lever 9, a locking plate 71 of the first rewinding lock 5 and a abutment cutter 74 of the cutting-off device rest on the base plate. Unlike the representation of FIG. 2, however, in this phase no band has yet been introduced into the strapping apparatus.

The second and third rewinding locks 6, 29 are released at this point in time. In other words, the locking plate 66 of the second rewinding lock 6 is arranged in a position in which it is at the greatest distance from the base plate 7. Furthermore, the catch 44 (FIG. 5) of the third rewinding lock is not in engagement with the ring gear 31 and the tensioning drive 2 has been lifted off the rocker 37. The welding device has likewise been raised from its arm 11 of the base plate 7.

Thereafter, the hand lever 9 is pivoted into an end position, in which it rests on the housing 1 above the pivoting drive (FIG. 1). This first movement of the hand lever 9 is transmitted via the first pivot arm 13 to the control board 14. The control board 14 in turn turns the second pivot arm 15. Since, in this position, the claws 54*b*, 54*d* of the second pivot arm 15 are in engagement with the claws 54*a*, 54*c* of the indexing plate 51, the rotational movement is transmitted to the indexing plate 51 and, as a result, also to the rotational spindle 18. This movement of the rotational spindle 18 leads in turn to the coupling (driving cams 49, 50) between the rotational spindle 18 and the first rewinding lock 5 coming into engagement. As a result, the rotational movement of the rotational spindle 18 is transmitted to the rewinding lock 5, whereby the locking plate 71 lifts off from the base plate 7. Furthermore, on account of the cam 77 turning along with the hand lever 9, the abutment cutter 74 of the cutting-off device is also lifted off the base plate 7, whereby a band guide of the strapping apparatus for the insertion of an end of the band 75 is fully released (FIG. 1).

Thereafter, the band can be inserted into the strapping apparatus and placed around goods. During this operation, a band loop 46 should be passed through an opening 76 in the base plate 7 and placed in the apparatus in such a way that both the end of the band 75 and a further section of the band loop 46 are under the rewinding lock 6, while only the extended end of the band 75 is arranged under the rewinding lock 5.

Subsequently, the hand lever 9 is pivoted back into the intermediate position according to FIGS. 2 and 3. Since the hand lever 9 is spring-loaded, it is only necessary to let go of it for this purpose, whereby it assumes the intermediate position of its own accord. By this movement of the hand lever 9, the eccentric spindle 48 is turned via the indexing plate 51 in the anticlockwise direction (direction of rotation with regard to the representation of FIGS. 1 to 3), whereby the first rewinding lock 5 is lowered onto the arm 12 of the base plate 7 and the locking plate 71 clamps the beginning of the band 75 between it and the base plate 7. This movement of the hand lever also leads to the effect that the cam 77, which is likewise situated on the rotational spindle 10 of the hand lever 9, actuates a control plate 78 of the cutting-off and closure device 3, 4. In the case of the closure device shown in FIGS. 16 to 18, the cam 77 actuates the abutment cam 81. As a result, the abutment cutter 74 is lowered onto the band, while the state of the closure device remains unchanged. Furthermore, now at the latest, the band 45 should also be inserted into the gap between the tensioning wheel 30 and the abutment rollers 39, 40 of the rocker 37 (cf. FIGS. 5, 6, 7).

In order to tension the band, then a tensioning button (not represented) of the hand lever 9 is actuated, whereby the d.c. motor of the tensioning drive 2 is started up. The driving movement of the motor is transmitted via the planetary gear mechanism to the tensioning wheel 30, which—through an anticlockwise rotational movement—pulls the band back in the direction (arrow 43 in FIGS. 2 and 5) of a supply roller (not represented). The movement of the tensioning wheel is stopped when the envisaged tension has been applied to the band, for which purpose the instantaneous actual motor current is compared with a setpoint value of the current. When the setpoint value is reached, the motor is switched off, the setpoint value of the motor current corresponding to a certain desired setpoint band tension of a particular type of band.

During this tensioning phase, the rewinding lock 5 clamps the end of the band. Furthermore, the catch 28 is located in the position shown in FIG. 6, in which it allows a rotational movement only in one direction of rotation of the ring gear 31, turning counter to the direction of rotation of the tensioning wheel 30. Since the ring gear 31 is coupled rotatably to the tensioning wheel, the tensioning wheel is thereby locked against rotational movements counter to the tensioning direction. The tensioning wheel can consequently turn at most by 180° in the direction opposite to the tensioning direction. Then at the latest, the catch snaps into one of the two depressions 35, 36 in the ring gear 31.

Figure 11:
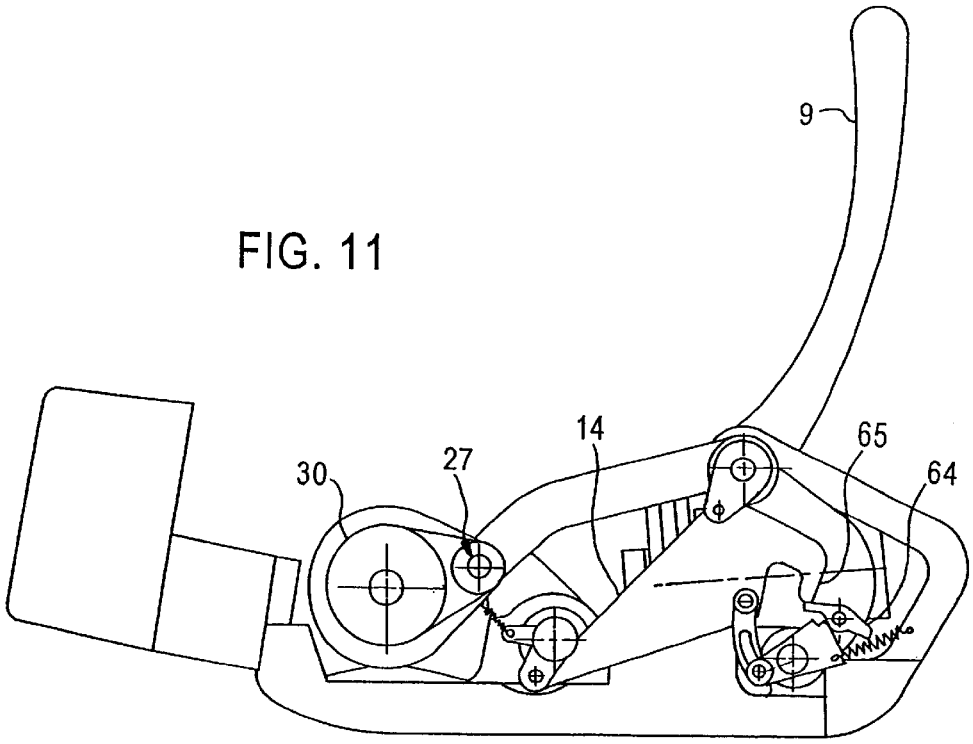
FIG. 11 shows a representation of the strapping apparatus according to FIG. 3, the hand lever being located in a second end position.
Figure 12:
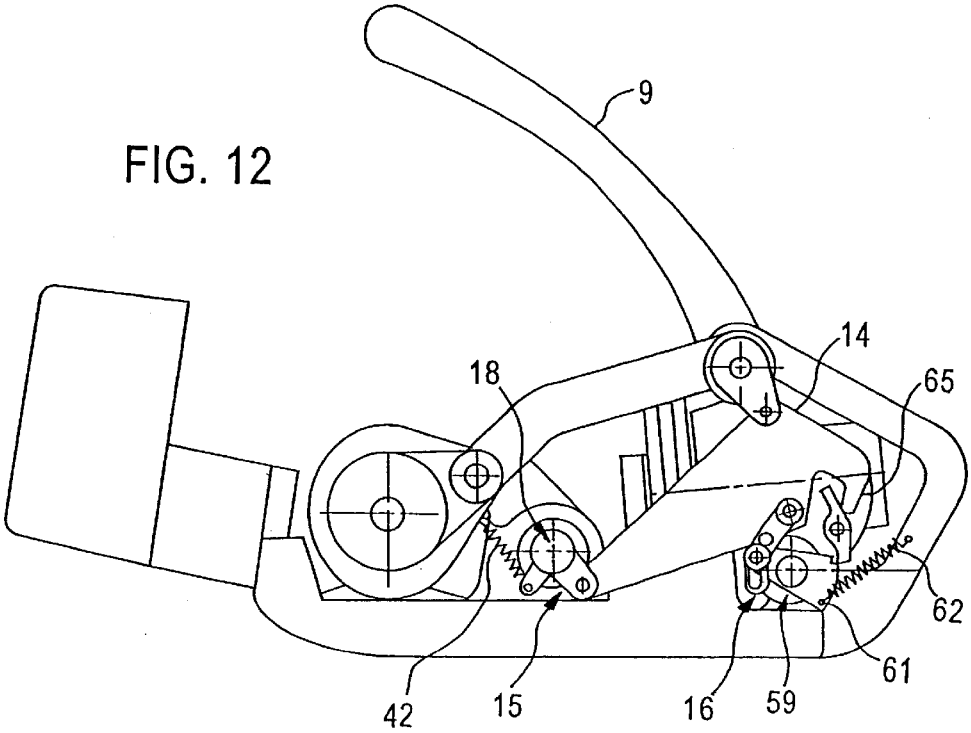
FIG. 12 shows a representation of the strapping apparatus according to FIG. 3, the hand lever being located in an intermediate position.

Once this tensioning phase has been completed, the hand lever 9 is transferred—starting from the intermediate position (cf. FIG. 2 and FIG. 3)—into its second end position, which is shown in FIG. 11. The movement of the control board 14 initiated as a result leads to the effect that the lug 65 of the control board 14 turns the catch 64 out of its locking position, whereby the catch lever 59 becomes free for anticlockwise rotational movements. In the course of the movement of the hand lever 9 in the direction of its second end position, the butt strap 16 can then turn the catch lever 59 in the anticlockwise direction (FIG. 12). Unlike in the case of the movement of the hand lever 9 from the intermediate position into the first end position and back, the catch lever then rests on one of the ends of the slotted link 17 and is coupled by the butt strap 16 to the movement of the control board 14.

Since the catch lever 59 is connected in a rotationally fixed manner to the rotational spindle 56, the movement of the catch lever 59 leads to a lowering of the locking plate 66 in the direction of the base plate 7, whereby the rewinding lock 6 clamps the band. On account of the coupling of the locking plate 66, described above, it is ensured that the locking plate is aligned essentially parallel to the slope 67 of the base plate 7 right from the first contact with the band and, as a result, the band can be clamped very quickly.

In the further course of the movement of the hand lever 9 in the direction of its second end position, the control board 14 comes into a position in which the second pivot arm 15 is positioned in such a way that the coupling between the pivot arm 15 and the double lever 19 engages. Until the hand lever 9 has reached its second end position, the second pivot arm 15 turns the double lever 19 in the anticlockwise direction from the position shown in FIG. 6 into the end position shown in FIG. 7. As can be seen in FIG. 6, the double lever 19 has no contact with the lever arm 24 of the second double lever 25 during the tensioning phase. Only in the course of the further movement of the hand lever 9 does one of the two arms 20, 21 press against the lever arm 24. As a result, the catch 28 releases the ring gear 31. The third rewinding lock, acting on the tensioning wheel 30, is consequently released. This brings about the effect that the previously applied band tension is essentially resumed by the section of band between the tensioning wheel 30 and the second rewinding lock 6. The band tension on the band loop situated essentially between the two rewinding locks 5, 6 remains unchanged, however.

By a further pivoting movement of the hand lever 9 in the direction of a second end position, the abutment cutter 74 is then activated and detaches the band loop 46 from the band. Subsequently, the welding device joins the two ends of the band by friction welding. Both operations are initiated by the hand lever 9, the movement of which is transmitted from the cam 77 to the control plate 78, which in turn activates the abutment cutter and the welding device. Both the cutting operation and the welding operation are made considerably easier by relieving the section of band directly affected by this.

What is claimed is:

1. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band; and a plurality of rewinding locks for fixing the band on the strapping apparatus, wherein with regard to the tensioning direction, the tensioning wheel and the rocker are arranged downstream of the closure device.

2. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band; and a plurality of rewinding locks for fixing the band on the strapping apparatus, wherein the rocker is provided with two abutment rollers each mounted rotatably on an axis, the axes being aligned substantially parallel to the rocker axis of the rocker, and, with regard to the tensioning direction, one of said axes being arranged upstream of the rocker axis while the other being arranged downstream of the rocker axis.

3. The strapping apparatus according to claim 1, wherein the rocker is provided with a supporting surface onto which the band can be pressed by the tensioning wheel.

4. The strapping apparatus according to claim 3, wherein the supporting surface has a curvature, at least one section of the curvature of the supporting surface having a radius substantially corresponding to a radius of the tensioning wheel.

5. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band, and a plurality of rewinding locks for fixing the band on the strapping apparatus, wherein with regard to the tensioning direction, one of the rewinding locks is arranged upstream of the closure device.

6. The strapping apparatus according to claim 1, wherein one of the rewinding locks is arranged to block the tensioning wheel against rotational movements counter to the tensioning direction.

7. The strapping apparatus according to claim 1, wherein the rocker is mounted on a base plate on which components of the strapping apparatus are supported.

8. The strapping apparatus according to claim 7, wherein the base plate includes a first part assigned to the closure device and a second part assigned to the tensioning device, the rocker is mounted on the second part of the base plate, and the first and second parts of the base plate are spaced by a gap through which the band extends.

9. The strapping apparatus according to claim 1, wherein the closure device comprises a welding device, the welding device having:

a lever;

a motor shaft acting upon one end of the lever;

an eccentric operatively connected to the motor shaft and the lever for transmitting an eccentric movement to the lever; and a welding shoe coupled to the other end of the lever, the lever being mounted pivotably on a pivot spindle so that the eccentric movement results in an oscillating reciprocating movement of the welding shoe.

10. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a plurality of rewinding locks for fixing the band on the strapping apparatus;

a hand lever;

a base plate; and a welding device for sealing two portions of the band, the welding device having:

a support positioned on the base plate of the strapping apparatus via a rotational spindle;

a lever;

a driving mechanism mounted on the support and having a driving motor shaft acting upon one end of the lever;

an eccentric operatively connected to the motor shaft and the lever for transmitting an eccentric movement to the lever;

a welding shoe coupled to the other end of the lever, the lever being mounted pivotably on a pivot spindle positioned on the support so that the eccentric movement results in an oscillating reciprocating movement of the welding shoe; and a transmitting element situated on the rotational spindle and operatively connected to the lever for transmitting a pivoting movement of the hand lever of the strapping apparatus to the welding shoe.

11. The strapping apparatus according to claim 10, wherein the transmitting element is constructed as a bow, and the transmitting element and the lever are operatively connected via an elastic element arranged between the transmitting element and the support.

12. The strapping apparatus according to claim 10, wherein the support is supported by an elastic element positioned on either an arm fixed to the base plate, or on the base plate itself.

13. The strapping apparatus according to claim 10, wherein the lever is a bent lever.

14. The strapping apparatus according to claim 5, wherein the closure device comprises a welding device, the welding device having:

a lever;

a motor shaft acting upon one end of the lever;

an eccentric operatively connected to the motor shaft and the lever for transmitting an eccentric movement to the lever; and a welding shoe coupled to the other end of the lever, the lever being mounted pivotably on a pivot spindle so that the eccentric movement results in an oscillating reciprocating movement of the welding shoe.

15. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band;

a plurality of rewinding locks for fixing the band on the strapping apparatus; and a plate-shaped control board operatively connected to an actuating member and a plurality of transmitting members, wherein a movement of the actuating member results in a pivoting movement of the control board which, in turn, is transmitted to the transmitting members for switching the rewinding locks between a locking position and a release position.

16. The strapping apparatus according to claim 15, wherein at least one of said transmitting members is a rotational spindle for actuating at least one of said rewinding locks, said strapping apparatus further comprises at least one coupling between said at least one transmitting member and said at least one rewinding lock for locking and releasing said at least one rewinding lock in accordance with rotational positions of the spindle.

17. The strapping apparatus according to claim 16, further comprising a another rotational spindle coupled to the control board for switching at least two of said rewinding locks.

18. The strapping apparatus according to claim 16, wherein said at least one rewinding lock is mounted by a locking lever on an eccentric spindle, the eccentric spindle executes an eccentric movement with respect to the rotational spindle, and, at certain rotational positions of the rotational spindle with respect to the eccentric spindle, rotary relative movements can be executed by the locking lever.

19. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band;

at least one rewinding lock for fixing the band on the strapping apparatus; and a base plate includes a first part assigned to the closure device and a second part assigned to the tensioning device, and the first and second parts of the base plate being spaced by a passage through which the band passes.

20. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band; and at least one rewinding lock for fixing the band on the strapping apparatus, wherein said at least one rewinding lock has a locking lever mounted on an eccentric spindle connected to and arranged eccentrically with respect to a rotational spindle.

21. The strapping apparatus according to claim 20, wherein the locking lever can be connected in a rotary manner to the rotational spindle via a coupling and is arranged in a freely rotatable manner on the eccentric spindle.

22. A strapping apparatus for strapping goods with a band in a tensioning direction, the strapping apparatus having:

a tensioning device operatively connected to a tensioning drive and arranged to tension the band, the tensioning device having a rocker arranged opposite a tensioning wheel, the rocker being mounted pivotably on a rocker axis, the tensioning wheel and the rocker being adapted to move towards each other to clamp the band therebetween;

a closure device for sealing two portions of the band; and at least one rewinding lock for fixing the band on the strapping apparatus, wherein the tensioning device has a gear mechanism with at least three step-down stages.

* * * * *